US008610352B2

(12) United States Patent
Botto et al.

(10) Patent No.: US 8,610,352 B2
(45) Date of Patent: Dec. 17, 2013

(54) PARTICLE ACCELERATION DEVICES AND METHODS THEREOF

(75) Inventors: Tancredi Botto, Cambridge, MA (US); Martin Poitzsch, Derry, NH (US)

(73) Assignee: Schlumberger Technology Corporation, Sugar Land, TX (US)

( * ) Notice: Subject to any disclaimer, the term of this patent is extended or adjusted under 35 U.S.C. 154(b) by 843 days.

(21) Appl. No.: 12/210,307

(22) Filed: Sep. 15, 2008

(65) Prior Publication Data

US 2009/0072744 A1 Mar. 19, 2009

Related U.S. Application Data

(60) Provisional application No. 60/972,377, filed on Sep. 14, 2007.

(51) Int. Cl.
*H05H 9/00* (2006.01)

(52) U.S. Cl.
USPC ..... 315/5.41

(58) Field of Classification Search
USPC ..... 315/111.41, 111.61, 5.41, 5.42, 5.43, 315/5.44
See application file for complete search history.

(56) References Cited

U.S. PATENT DOCUMENTS

| | | | | |
|---|---|---|---|---|
| 5,122,662 | A | 6/1992 | Chen et al. | |
| 5,293,410 | A | 3/1994 | Chen et al. | |
| 5,440,211 | A | 8/1995 | Jongen | |
| 6,496,632 | B2 * | 12/2002 | Borrelli et al. | 385/123 |
| 6,801,107 | B2 * | 10/2004 | Chen et al. | 333/234 |
| 6,917,741 | B2 * | 7/2005 | Fekety et al. | 385/125 |
| 7,117,133 | B2 * | 10/2006 | Chen et al. | 703/2 |
| 2002/0190655 | A1 * | 12/2002 | Chen et al. | 315/4 |
| 2008/0068112 | A1 * | 3/2008 | Yu et al. | 333/228 |

FOREIGN PATENT DOCUMENTS

| | | | |
|---|---|---|---|
| RU | 2044421 | C1 | 9/1995 |
| RU | 2104621 | C1 | 2/1998 |
| SU | 818459 | A1 | 2/1982 |
| WO | 9222190 | A1 | 12/1992 |

OTHER PUBLICATIONS

Decision on grant of Russian Application Serial No. 2009129415 dated Oct. 11, 2011.
International Search Report and Written Opinion of PCT Application Serial No. PCT/US2008/076362 dated Dec. 15, 2008.
M. A. Shapiro et al., "Improved Photonic Bandgap Cavity and Metal Rod Lattices for Microwave and Millimeter Wave Applications," IEEE MTT-S Digest, 2000: pp. 581-584.

(Continued)

*Primary Examiner* — Minh D A
(74) *Attorney, Agent, or Firm* — Jakub M. Michna; Rachel E. Greene; Bridget Laffey

(57) ABSTRACT

A particle accelerator device structured and arranged for use in a subterranean environment. The particle accelerator device comprising: one or more resonant Photonic Band Gap (PBG) cavity, the one or more resonant PBG cavity is capable of providing localized, resonant electro-magnetic (EM) fields so as to one of accelerate, focus or steer particle beams of one of a plurality of electrons or a plurality of ions. Further, the particle accelerator device may provide for the one or more resonant PBG cavity to include a geometry and one or more material that is optimized in terms of RF power losses, wherein the optimization provides for a PBG cavity quality factor significantly higher than that of an equivalent normally conducting pill-box cavity.

48 Claims, 2 Drawing Sheets

(56) References Cited

OTHER PUBLICATIONS

D. Newsham et al., "Multi-Beam Photonic Band Gap Structure," IEEE T1.5, 2002: pp. 109-110.
A. Smirnov et al., "PBG Cavities for Single-Beam and Multi-Beam Electron Devices," IEEE Proceedings of the 2003 Particle Accelerator Conference, 2003: pp. 1153-1155.
N. Kroll et al., "Photonic Band Gap Accelerator Cavity Design at 90 GHz," IEEE Proceedings of the 1999 Particle Accelerator Conference, 1999: pp. 830-832.
S. Schultz et al., "Photonic Band Gap Resonators for High Energy Accelerators," IEEE PAC 1993: pp. 2559-2563.
N. Kroll et al., "Photonic Bandgap Sttructures: A New Approach to Accelerator Cavities," American Institute of Physics, 1993: pp. 197-211.
P. Pottier et al., "Triangular and Hexagonal High Q-Factor 2-D Photonic Bandgap Cavities on III-V Suspended Membranes," Journal of Lightwave Technology, Nov. 1999, vol. 17(11): pp. 2058-2062.
Joannopoulos et al., "Chapter 5: Two-Dimensional Photonic Crystals and Chapter 7: Designing Photonic Crystals for Applications," Photonic Crystals: Molding the Flow of Light, Princeton, NJ: Princeton University Press, 1995: pp. 54-77 and 94-103.
Smirnova et al., "Demonstration of a 17-GHz, High-Gradient Accelerator with a Photonic-Band-Gap Structure," Physical Review Letters, Aug. 2005, vol. 95: pp. 074801-1-074801-4.

* cited by examiner

PARTICLE ACCELERATION DEVICES AND METHODS THEREOF

CROSS REFERENCE TO RELATED APPLICATION

This application claims priority to U.S. provisional application Ser. No. 60/972,377, filed on Sep. 14, 2007, which is incorporated herein by reference.

BACKGROUND OF THE INVENTION

1. Field of the Invention

This invention relates to particle acceleration devices and methods thereof. More particularly, the invention relates to particle acceleration devices and methods used for measuring properties of subterranean formations such as in borehole logging or wellbore applications.

2. Background of the Invention

Nuclear borehole logging measurements typically employ one or more unstable radio-chemical isotopes such as $^{137}$Cs or AmBe to generate fixed-energy gamma or neutron radiation (logging sources). Due to the requirements of the oil industry, such sources are of extremely high intensity and radio-activity, often exceeding 2 Ci for $^{137}$Cs and 20 Ci for AmBe. As such, their deployment in oilfields worldwide is strictly controlled and regulated. The use of such sources forces the well-logging industry to manage great safety and security risks.

Alternative, "source-less" methods exist such as X-ray tubes, betatrons and minitrons (see e.g., U.S. Pat. Nos. 5,122,662 and 5,293,410 by F. Chen et al.). X-ray tubes are essentially electro-static accelerators and as such they are limited to energies of a few 100 KeV that can be reached with DC electric fields. Betatrons are in principle capable to reach very high energies however it remains a challenge to do so in the confined space of a logging tool. Minitrons are powerful, extremely compact neutron sources, however reaching further increases in output and lifetime remains extremely challenging. Linear accelerators can be utilized to accelerate electrons onto a radiator target to produce X-rays or to accelerate protons or other nuclei onto nuclear targets (e.g., Be, Li) to produce neutrons. Linear acceleration schemes based on traditional RF acceleration from a pillbox type microwave cavity (normally conducting pill box cavity) are notoriously difficult to scale for borehole applications, given the excessive power consumption, tool length and tool weight. As such they have never been employed in the oilfield.

An acceleration method is disclosed that relates to photonic band gap cavities (PBG cavity). A suitably designed resonator based on a PBG structure confines only the desired oscillating modes of electromagnetic fields, such as those required for particle acceleration. This property of a PBG cavity is well described in the scientific literature, including, for example J. D. Joannopoulos, R. D. Meade, and J. N. Winn, *Photonic Crystals: Molding the Flow of Light* (Princeton, N.J.: Princeton University Press, 1995).

With a PRG resonator operating at microwave frequencies in the GHz region, the RF power coupled externally via—e.g.—a coaxial loop or a wave-guide, can be concentrated in a very small volume providing a localized accelerating gradient. Mode selection inside the cavity ensures that only the wanted acceleration modes are present. This allows for an efficient use of RF power in an ideal compact geometry where wall losses are greatly reduced. The underlying principle of PBG cavity is universal and as such PBG cavities can operate in a broad range of frequencies.

A PBG-based electro-magnetic resonator (a cavity) consists of a symmetrical arrangement of plates and rods. An inverse structure with a symmetrical arrangement of cylindrical holes bored into a solid template may also be used. In either case the periodic structure is designed in such a way that the propagation of electro-magnetic waves in certain TE and/or TM modes in a given frequency range (the band-gap) is effectively forbidden. This feature depends principally on the boundary conditions and the geometry of the cavity.

A suitable PBG cavity would consist of symmetric plate-rod structure. Such a structure would also contain one or more introduced defects such as a missing or partially withdrawn rod. The volume around the defect is open to the electromagnetic mode whose propagation is elsewhere blocked by the band gap. In other words, the modes in the band gap are confined to the rod structure only and are by their very nature discrete. By introducing a defect while still preserving the symmetry properties of the resonator we have access to the confined, mode-selected fields that would otherwise be confined inside the rods. These fields effectively are those of a resonant cavity. Similarly, when the cavity consists of holes: the electro-magnetic modes may be confined to the holes.

U.S. Pat. No. 6,801,107B2 by Temkin et al. describes a PBG cavity that is suitable for frequency-filtering in the microwave regime. In particular, the Temkin device relates to vacuum electron devices that comprises a Photonic Band Cap (PBG) structure (or cavity) capable of overmoded operation, as well single mode operation. One distinct advantage of PBG cavities used for particle acceleration relative to prior art is that practically all undesired higher-order electromagnetic modes are not confined by the defect structure and therefore leak away with minimal effect on the electrons or ions in the beam.

SUMMARY OF THE INVENTION

At least one embodiment of the particle acceleration scheme is disclosed for use in subterranean formations such as for borehole and well-logging applications. In this scheme, particle beams of electrons or ions can be accelerated by the localized electric fields oscillating at high frequencies in resonant photonic band gap cavities. By employing one or multiple evacuated cavities structures, particle beams confined to a vacuum system can be accelerated up to energies of several MeV. Such energetic particle beam can then directed toward one or more targets of many possible materials, to generate gamma-ray or neutron radiation fields. With this device, it is possible to develop a compact, efficient borehole accelerator tool with which it becomes possible to perform a variety of well-logging measurements while overcoming the operational and security risks associated with the high-activity radio-chemical gamma or neutron sources typically used in the well-logging industry. For the purposes of this invention, borehole logging can be considered the science dedicated to measurements of rock or reservoir geophysical properties in subsurface wells.

An advantage of many of the schemes disclosed in this invention is improved power efficiency: power consumption is a pressing demand for borehole tools. It is estimated that, near-term, only a few kW of average power will be available in a wire-line configuration. However only a fraction of that power will be available to the accelerator tool and in addition the required high microwave power levels must be sustained up to very high ambient temperatures. PBG electro-magnetic cavities efficiently confine the accelerating electrical field to a small-volume region, resulting in less stored energy for the same accelerator gradient and smaller power losses.

A further advantage of the scheme according to the invention is that the cavity comprising dielectric rods with a low loss factor gives higher Q-factors compared to a cavity with metallic rods such as that of U.S. Pat. No. 6,801,107 B2 by Chen et al. A high cavity quality factor results in a further reduction of input power requirements. This increase in efficiency is important for borehole applications for the reasons given above.

According to another embodiment of the invention, another advantage is that an improved Q-factor may also be obtained in a cavity structure with no end plates or by providing axial confinement by means of an end-cap structure or end plate structure (layered or monolithic) made of dielectric and/or metallic materials which may include hollow or evacuated layers.

A further advantage of the scheme according to the invention is its compactness: by utilizing PBG resonators with small losses relative to pill-box cavities, one can reduce the tool length and weight. The optimal down-hole tool will preferably fit in a standard length tool section (20 feet or less) and will be manned by a standard crew without requiring the use of cranes for lifting. At 10 GHz, the required PBG cavity diameter is of only a few cm.

Advantageously, the PBG resonator confines only the desired cavity modes in the region of the particle beam. Other modes are free to propagate and will quickly damp at the walls. This provides suppression of unwanted (higher-order) modes that can "blow up" or defocus the beam including wakefields. Wakefields excited by a charged beam traversing a classical pill-box RF cavity are a strong function of the operating frequency ($\sim\omega^3$) and would otherwise limit operation at very high frequencies. On the other hand high-frequency operation is desired since it brings about a compact size and improves power efficiency.

High frequency operation in the GHz region is also advantageous since it can ultimately provide a nearly continuous particle beam with a near unity duty factor. The duty factor and time structure of the beam critically affect the ability to perform measurements such as density logging in the preferred single-photon counting mode.

A power-efficient linear acceleration scheme such as the one proposed can also be advantageously utilized to provide a beam with lower energy but higher average current, up to a few 100 uA. The resulting radiation fields can have much higher intensity than those of conventional logging source sand one can therefore achieve better accuracy or reduced counting time for nuclear well logging measurements.

Furthermore, high electron energies achievable with a PBG accelerator result in an improved bremsstrahlung yield from a thick high-Z target, resulting in a higher flux of photons available.

Photons with energies higher than those from conventional logging sources and/or more intense photon fluxes are more penetrating and as such they have an increased depth-of-investigation for density logging kind of measurements, including logging behind casing.

An accelerator beam is an intrinsically safe source of radiation fields as the radiation output can be entirely controlled electronically.

Some of the particle acceleration schemes disclosed according to the invention also provide optimized vacuum packaging with open PBG structures in a single vacuum enclosure (super-cells or infinite cells). This allows for better pumping and also better thermal insulation.

The invention also provides improved stability of the cavity tune as a function of temperature: detuning effects in a pillbox RF cavity would naturally occur in a borehole due to local cavity heating such heating due to power losses as well as increased ambient temperatures due to the geo-thermal gradient. Changes in temperature result in a change of cavity dimensions and thus a cavity tune shift. Reduced ohmic losses in PBG resonators of type described above result in less overall heating. In addition, improved thermal insulation can be obtained with open PBG cavity structures in a common vacuum envelope, and/or dielectric materials may be used with smaller coefficient of thermal. Finally, the cavity frequency in a PBG resonator is a function of the ratio of rod spacing to rod diameter, which is less sensitive to thermal effects than just the cavity radius in a pill-box cavity.

Advantageously, the PBG structure can also be designed to confine dipole, quadrupole or other multipolarity electromagnetic modes around the defect region. This could allow for beam steering or focusing.

The PBG technology is scalable and can also be employed to confine electric fields at much smaller wavelengths such as those associated with optical sources including diode, semiconductor or fiber lasers, while still providing the many benefits mentioned above relevant to down-hole logging. A suitable accelerator mode can be supported by a photonic "holey" fiber or MEMS structure excited by a laser beam.

DETAILED DESCRIPTION OF THE PREFERRED EMBODIMENTS

A particle accelerator scheme is disclosed for example in the implementation to borehole and well-logging applications. In this scheme, particle beams of highly relativistic electrons or ions are created by passage through one or multiple acceleration cells, some or all of which may be realized with a photonic band-gap cavity. Each cavity acts as a means to couple a high electric field to particles travelling in a vacuum enclosure inside a geometrically constrained logging tool. In particular, for a particle accelerator cavity to be used in a subterranean environment, e.g., down-hole tool, a set of optimizations is required that is over and above the stated prior art. For example, the PBG geometry and materials in terms of RF power losses must be optimised, as well as the opening for the beam and coupling to external RF sources. New implementations become possible when utilizing several PBG cavities, similar to the more conventional approaches based on pill-box type of EM resonators.

Figure 1:
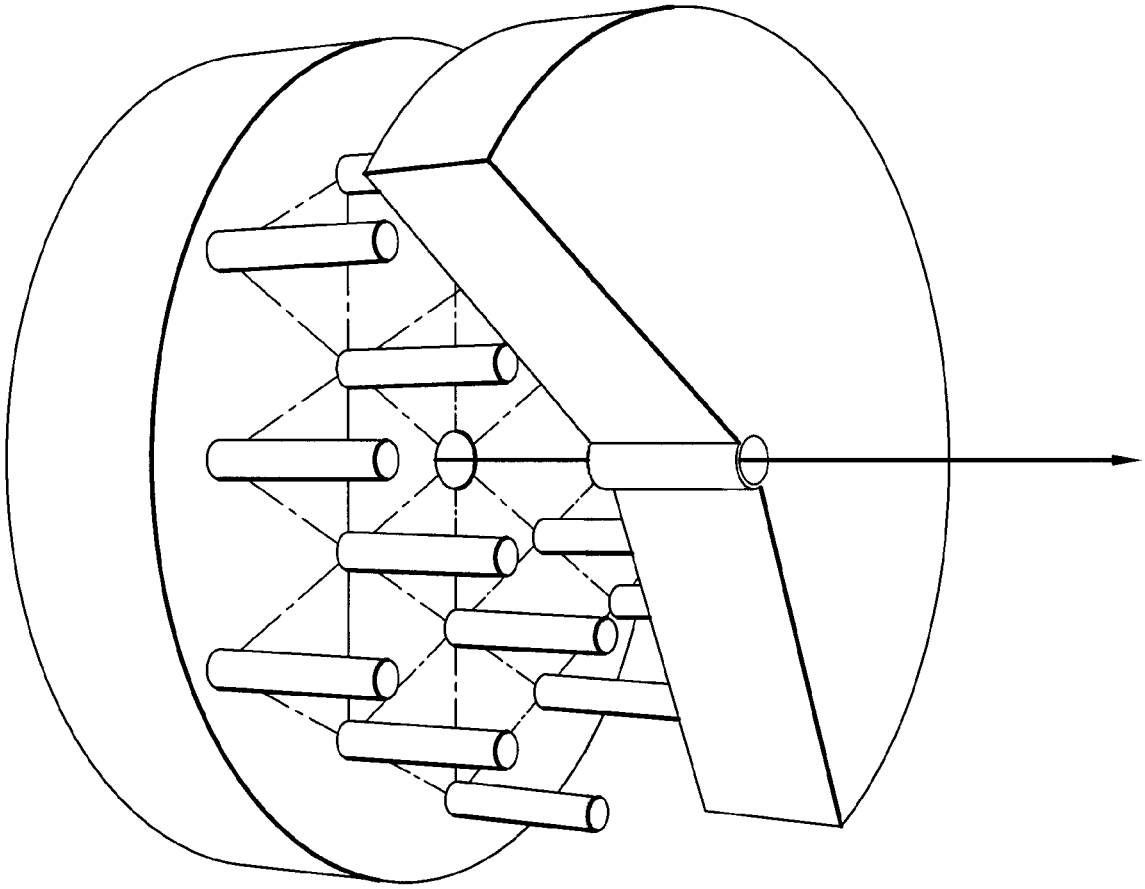
FIG. 1 is an example of a PBG resonant cavity structure, according to an embodiment of the invention.

A suitable PBG cavity may comprise two or more end-plates (e.g., two or more end-caps) connected by symmetrically spaced rods. One particularly advantageous configuration is the triangular lattice (see FIG. 1). The end-plates (e.g., end-caps) of the cavity are typically parallel to each other and may have a round or any other cross section. The end-plates (e.g., end-caps) of the cavity may be tapered or shaped in order to more efficiently focus the accelerating field. The rods may have circular, elliptic or other cross-sections, including varying cross sections. In addition, the volume between the end-plates (e.g., end-caps) and including the inner rods of a PBG may be fully or partially enclosed by exterior walls or enclosed in a separate vacuum chamber superstructure.

By choosing the correct geometrical arrangement, materials and coupling scheme one can create a band-gap or a range of frequency for which no EM-mode propagation is possible inside the cavity and fields are confined at the rods. When at least one of the rods is missing, one purposedly introduces a defect in the resonator structure. This creates one or more regions where high power electromagnetic radiation is localized (see FIGS. 2*a* and 2*b*). One may also create defects using special geometry rods, such a hollow rods, split-rods, partially withdrawn rods or rods with different geometries. Further, FIG. 2*b* shows as aspect of the invention, e.g., the dipole mode.

Figure 2A:
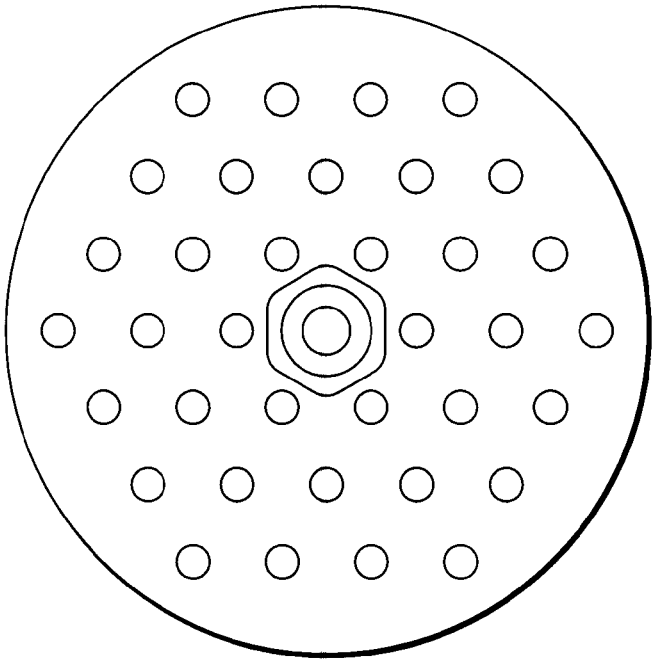
FIG. 2A and FIG. 2B represent mode maps of a resonant PBG cavity structure showing confinement of the desired $TM_{01}$ mode around a defect in the center, according to an embodiment of the invention.
Figure 2B:
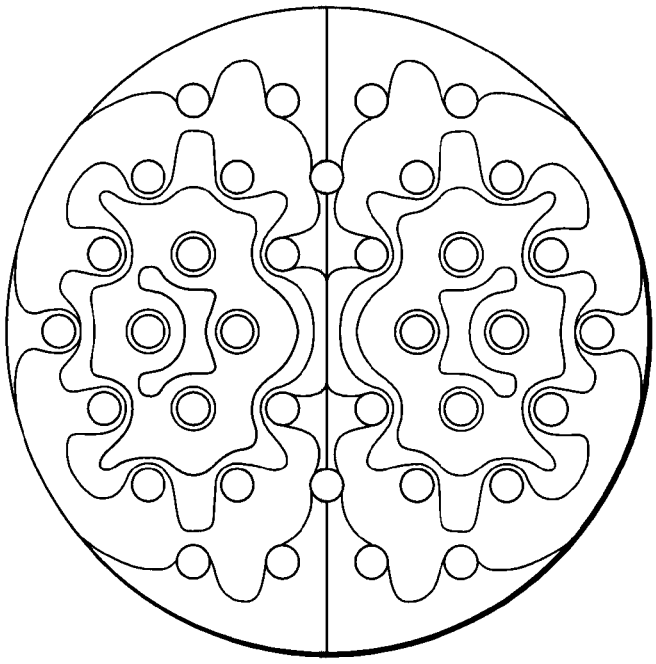

With this arrangement one can, e.g., create a longitudinal electric field (TM01 mode), see FIG. 2*a*) suitable for particle acceleration in the region where the particle beam is to traverse the cavity. The band-gap mode frequencies depend on rod spacing, diameter and shape, as well as rod placement and overall cavity geometry. At 10 GHz frequencies, this corresponds to spacing between the rods in the cm scale for rod diameters of a few mm. Generally, operating at higher frequencies will involve smaller distances and diameters.

The plates, rods and walls, or parts thereof, may consist of metallic conductors, dielectric insulators or coated metals or insulators, or a combination of metallic and dielectric elements. Use of rods or plates (e.g., end-caps) made of dielectric material with very low loss factors in the frequency region of interest (10's of GHz) such as Alumina (Al2O3) or single crystalline sapphire minimizes losses and improves the resonant property of the cavity (quality factor or Q-factor). This in turn provides a more power efficient design. The overall Q-factor in a cavity is limited by its intrinsic Q-factor, before dielectric or ohmic losses, which is typically very high (Q~up to $10^6$). By minimizing ohmic losses the Q-factor approaches its high intrinsic value and the power consumption is optimized. Since the amount of RF power available in a downhole tool is limited, by non-limiting example, to approximately a few kW (average power) it is preferable to keep losses to a minimum. Increased power deliverable to the cavity allows for increased beam energy and/or beam intensity.

To optimise losses the rods may be of different materials, and the cavity may be partially or fully loaded with a dielectric medium. Hollow rods with cooling help reduce the dielectric loss-tangent. Such fine tuning could be also advantageous to better shape the electric field and/or improve mode selection inside the cavity, and finally to optimize the cavity dimensions and operating frequency with respect to the constraints typical of borehole tools. The use of absorbing material on the cavity walls helps to further damp all of the unwanted delocalized oscillation modes outside the band-gap.

A perfect band-gap might not be penetrated from outside. In order to couple the cavity to an external excitation source, some of the rods from the external rows must be removed or partially withdrawn. Alternatively one may use thinner diameter rods. This does not significantly affect the field in the central region, which to first order is shaped by the inner rows of rods, whereas the outer rods provide focussing and confinement of the accelerating mode in the defect region. Coupling to the external source may also be achieved with a coupling loop at the end of a coaxial transmission line, including a balanced transmission line. Alternatively, a specially designed waveguide can be employed.

At very high operation frequencies an equivalent PBG structure may be manufactured through micro or nano-fabrication (MEMS) techniques. In this case, one may use an optical power source such as a laser, instead of a microwave source.

In one embodiment, a borehole accelerator comprises of separate cavities, some of which being PBG cavities. The one or more cavity will be part of an evacuated beam line. Each cavity chamber will allow for at least one opening for beam propagation in and out of the cell. For at least one cavity cell, there should one opening for coupling in the external high-frequency power driving the resonator. Alternatively, it is also possible to couple multiple cells together into well-known single travelling or standing wave structure. In each cavity, field gradients up to a few MeV/m are possible, for input power levels of a few kW. Particles in phase relation with the electrical field in each of the acceleration cells will be accelerated to high energies while travelling along the length of the whole accelerator device. The distance between cells will vary in accordance with the speed of the particle beam in each section and the need to maintain phase relation between the electric field and the particle beam.

In another embodiment, a borehole accelerator structure comprises one or more super-cells. A super-cell comprises multiple PBG cavities inserted in a common vacuum enclosure. Each PBG cavity in a super-cell comprises a pair of plates connected by rods but the end-plates (e.g., end-caps) are now not connected by walls or are only partially connected by walls including walls with openings. This realization allows for easier pumping over the length of the accelerator. Different coupling mechanisms can be used to deliver RF power to the region between the plates defining each PBG cavity, and the particle beam may propagate in between cavity sections through drift regions in vacuum or one may also use irises or diaphragms in between cavities to better optimise the accelerating RF field.

In yet another embodiment a borehole accelerator structure comprises one "infinite" PBG cavity with no end plates or plates kept at large distance. In this realization, the PBG cavity can be described as two-dimensional and as such one increases the quality of the resonator and minimizes losses at the end plates. In such an extended structure, the longitudinal field will perform one or more full oscillation cycle along the length of the cavity. When at the opposing phase, the field will decelerate the beam. To prevent this, the rods in the region where the field direction is opposing the incoming beam may be shaped in such a way as to diffuse the localized field outside of the beam region and thus over the volume of the vacuum chamber. A section with thinner rods or greater rod spacing would allow the opposing field to be outside of the band-gap and thus "leak out" and be absorbed in the exterior vacuum chamber walls. This configuration may still provide net acceleration with an improved efficiency factor (Q-factor).

A borehole accelerator can also comprise any combination of the accelerator structures described above. For any such structure, partial recovery of exiting RF power should be possible.

The source of electrons may consist of a thermo-ionic gun, carbon nanotube emitter or MEMS-based field-emitter. Before entering the high-gradient section of the borehole accelerator, the initial energy of electrons could be raised to the nearly relativistic regime by either electrostatic acceleration (up to a few 100's of kV), acceleration via magnetic induction (such as with a compact betatron) or acceleration of the beam through circulation in other RF cavities, including a conventional microwave cavities.

What is claimed is:

1. A down-hole particle accelerator device comprising:

at least one resonant Photonic Band Gap (PBG) cavity configured to provide localized, resonant electro-magnetic (EM) fields so as to accelerate a charged particle beam in an axial direction, wherein the accelerated particle beam propagates out of the resonant PBG cavity and the localized, resonant EM fields are confined in the axial direction by a dielectric material.

2. The particle accelerator device of claim 1, wherein the at least one resonant PBG cavity includes at least one of a plurality of rods or a plurality of holes.

3. The particle accelerator device of claim 2, wherein the plurality of rods are symmetrically spaced rods configured according to one or more geometrical lattices.

4. The particle accelerator device of claim 2, wherein at least one rod from the plurality of rods is from a group consisting of a dielectric rod, a metal rod, a composite rod, a dielectric rod with a conductive coating, or any combination thereof.

5. The particle accelerator device of claim 2, wherein at least one rod from the plurality of rods has a cross-section including one of a hollow, a circular shape, a round shape, a tapered shape, an elliptic shape, a non-uniform cross section, or some combination thereof 6. The particle accelerator device of claim 2, wherein the at least one resonant PBG cavity includes at least two end-plates connected by the plurality of rods.

7. The particle accelerator device of claim 6, wherein the at least two end-plates have at least one entry and at least one exit opening for the particle beam.

8. The particle accelerator device of claim 6, wherein the at least two end-plates define two planes parallel to each other and have a cross section.

9. The particle accelerator device of claim 6, wherein the at least two end-plates are one of shaped or tapered along the axial direction so as to focus the resonant EM field along a direction of the particle beam.

10. The particle accelerator device of claim 6, wherein at least one end-plate from the at least two end-plates provides confinement of the localized, resonant electro-magnetic (EM) fields in the axial direction, wherein the at least one end-plate has one of a dielectric structure or a combination of a dielectric and metal structure.

11. The particle accelerator device of claim 10, wherein the at least one end-plate is one of a layered structure or a monolithic structure.

12. The particle accelerator device of claim 6, wherein a volume between the at least two end-plates containing the plurality of rods is fully enclosed by one or more exterior walls.

13. The particle accelerator device of claim 12, wherein the at least one resonant PBG cavity includes at least two resonant PBG cavities that are connected by an evacuated particle beamline.

14. The particle accelerator device of claim 12, wherein the at least one resonant PBG cavity includes at least two resonant PBG cavities that have a common end-plate.

15. The particle accelerator device of claim 6, wherein a common vacuum chamber superstructure contains the at least one resonant PBG cavity and one of the at least two end-plates, the plurality of rods, or some combination thereof 16. The particle accelerator device of claim 15, wherein the at least two end-plates are not connected other than by the plurality of rods.

17. The particle accelerator device of claim 15, wherein the at least one PBG cavity includes multiple resonant PBG cavities form a super-cell, such that at least two of the multiple resonant PBG cavities have a common end-plate.

18. The particle accelerator device of claim 15, wherein one or more vacuum levels in the common vacuum chamber superstructure traversed by the particle beam are maintained by activating at least one getter material located inside the common vacuum chamber superstructure.

19. The particle accelerator device of claim 6, wherein a common vacuum chamber superstructure contains the at least one resonant PBG cavity and the plurality of rods, such that at least two resonant PBG cavities of the at least one resonant PBG cavity are not separated by the at least one end-plate.

20. The particle accelerator device of claim 19, wherein one or more vacuum levels in the common vacuum chamber superstructure traversed by the particle beam are maintained by activating at least one getter material located inside the common vacuum chamber superstructure.

21. The particle accelerator device of claim 6, wherein at least one of:

at least one rod, at least one plate, at least one part of a plate, and at least one part of a rod, includes a low loss material.

22. The particle accelerator device of claim 6, wherein the at least two end-plates comprise one or more materials having substantially similar thermal expansion coefficients as the plurality of rods, so as to minimize variations in a ratio of a rod spacing to a rod diameter.

23. The particle accelerator device of claim 6, wherein the at least two end-plates are end-caps.

24. The particle accelerator device of claim 2, wherein a defect is introduced upon removal of at least one rod from the plurality of rods from the at least one resonant PBG cavity, resulting in one or more regions with localized electromagnetic radiation power.

25. The particle accelerator device of claim 2, wherein a defect is created using a rod from the group consisting of at least one special geometry rod, at least one hollow rod, at least one split-rod, and at least one partially withdrawn rod.

26. The particle accelerator device of claim 2, wherein the resonant EM fields of the at least one resonant PBG cavity are shaped in a direction parallel to the particle beam by one of a change of a geometrical arrangement of at least one rod from the plurality of rods, a change in a dimension or a shape of at least one rod from the plurality of rods, a change in a material composition of at least one rod from the plurality of rods, or any combination thereof.

27. The particle accelerator device of claim 2, wherein the resonant EM fields of the at least one resonant PBG cavity are shaped in a direction parallel to the particle beam by a periodic arrangement of at least two rods from the plurality of rods in a direction perpendicular to the particle beam.

28. The particle accelerator of claim 2, wherein the resonant EM fields outside the structure of the rods or the holes are damped by an absorbing material placed inside one of a cavity fully enclosed by walls or in a volume of an external vacuum chamber.

29. The particle accelerator device of claim 2, wherein a defect is introduced via at least one of a modified hole diameter, at least one of a modified hole cross section, and at least one of a modified hole position.

30. The particle accelerator device of claim 1, wherein the at least one resonant PBG cavity includes at least two end-plates and a plurality of rods having at least one material property from the group consisting of a metallic conductor, one or more coated dielectric insulators, a dielectric insulator, and one or more insulators.

31. The particle accelerator device of claim 1, wherein the at least one resonant PBG cavity includes at least one cavity where the particle beam is deflected by a localized resonating electric or magnetic dipole field.

32. The particle accelerator device of claim 1, wherein the at least one resonant PBG cavity includes at least one cavity where the particle beam is focused by a quadrupole or higher electric or magnetic multipole field.

33. The particle accelerator device of claim 1, wherein the at least one PBG cavity includes at least one mode selective PBG cavity that allows for operation at a higher frequency by minimizing an effect of wake-fields.

34. The particle accelerator device of claim 1, wherein a resulting accelerating gradient of the at least one PBG cavity provides for an accelerator tool with one of a length or a weight compatible for operating in a borehole environment.

35. The particle accelerator device of claim 1, wherein the at least one resonant PBG cavity is coupled to at least one EM excitation source by one or more coupling loops at an end of a transmission line.

36. The particle accelerator device of claim 1, wherein the localized EM fields are oscillating at above 1 GHz.

37. The particle accelerator device of claim 1, wherein the at least one resonant PBG cavity includes a plurality of components, wherein at least one component is temperature controlled.

38. The particle accelerator device of claim 37, wherein the at least one temperature-controlled component comprises a surface that is temperature controlled by contact with a fluid.

39. The particle accelerator device of claim 37, wherein improved cavity tuning stability against thermal expansion and contraction effects are obtained through a structure and arrangement of at least one rod, wherein the at least one rod is from the group consisting of a reduced variation of one of a rod diameter, a rod separation spacing, and a ratio of a rod spacing to a rod diameter, wherein the at least one rod is from a plurality of rods of the at least one resonant PBG cavity.

40. The particle accelerator device of claim 1, wherein improved cavity tuning stability is obtained through reduced thermal expansion or contraction effects on at least one cavity component due to heating from Ohmic or other RF-induced power losses.

41. The particle accelerator device of claim 1, wherein the particle accelerator device is configured to operate in one of a borehole and a wellbore application.

42. The particle accelerator device of claim 1, wherein the localized, resonant electromagnetic (EM) fields at least one of focus or steer the particle beams.

43. The particle accelerator device of claim 1, wherein the at least one resonant PBG cavity includes at least one opening for beam propagation out of the cavity.

44. The particle accelerator device of claim 1, wherein the dielectric material is a layered dielectric material.

45. The particle accelerator device of claim 1, wherein the charged particle beams are one of a plurality of electrons and a plurality of ions.

46. A down-hole particle accelerator device comprising:

at least one resonant Photonic Band Gap (PBG) cavity comprising:

at least two end-plates connected by a plurality of rods, wherein the PBG cavity is configured to provide localized, resonant electro-magnetic (EM) fields so as to accelerate a charged particle beam and the accelerated particle beam propagates out of the resonant PBG cavity in an axial direction and the localized, resonant EM fields are confined in the axial direction by a dielectric material.

47. A down-hole particle accelerator device comprising:

at least one resonant Photonic Band Gap (PBG) cavity comprising:

at least one plate comprising a dielectric material, wherein the PBG cavity is configured to provide localized, resonant electro-magnetic (EM) fields so as to accelerate a charged particle beam and the accelerated particle beam propagates out of the PBG cavity in an axial direction and the localized, resonant EM fields are confined in the axial direction by the at least one plate.

48. The particle accelerator device of claim 47, wherein the at least one resonant PBG cavity includes at least one of a plurality of rods or a plurality of holes.

* * * * *